US007762765B2

(12) United States Patent
Milks

(10) Patent No.: US 7,762,765 B2
(45) Date of Patent: Jul. 27, 2010

(54) FAN WITH ATTACHMENT HOOKS

(75) Inventor: Stephen A. Milks, Lapeer, MI (US); Penny Milks, legal representative, Lapeer, MI (US)

(73) Assignee: Fan-Tastic Vent, Imlay City, MI (US)

( * ) Notice: Subject to any disclaimer, the term of this patent is extended or adjusted under 35 U.S.C. 154(b) by 524 days.

(21) Appl. No.: 11/788,247

(22) Filed: Apr. 19, 2007

(65) Prior Publication Data

US 2008/0260554 A1 Oct. 23, 2008

(51) Int. Cl.
*F03B 11/03* (2006.01)
*F01D 25/28* (2006.01)
*F24F 7/00* (2006.01)

(52) U.S. Cl. ..... 415/121.2; 416/247 R; 454/230

(58) Field of Classification Search ..... 417/410.1; 454/338; 415/61, 121.2; 55/490; 119/601; 416/146 R, 247 R; 206/320
See application file for complete search history.

(56) References Cited

U.S. PATENT DOCUMENTS 2,390,588 A * 12/1945 Heckman ..... 417/321
D180,783 S 8/1957 Helms et al.
3,030,145 A 4/1962 Kottemann
3,144,574 A 8/1964 Hebry-Baudot
3,280,353 A 10/1966 Haydon et al.
3,348,086 A 10/1967 Monma
3,566,165 A 2/1971 Lohr
3,733,150 A 5/1973 Porter et al.
3,860,404 A 1/1975 Jochimski
3,879,623 A 4/1975 Miyake
3,890,963 A 6/1975 Patterson
4,141,320 A 2/1979 Hatfield
4,303,844 A 12/1981 Suzuki
4,633,769 A 1/1987 Milks
4,684,839 A 8/1987 Fujisaki et al.
5,099,181 A 3/1992 Canon
5,109,171 A 4/1992 Schmider
5,110,263 A 5/1992 Chiu
5,148,895 A 9/1992 Kakizaki
5,232,090 A 8/1993 Raab et al.
5,270,596 A 12/1993 Shibuya et al.
5,660,367 A 8/1997 Rush
5,725,356 A 3/1998 Carter
5,839,205 A 11/1998 Hung
5,929,544 A 7/1999 Maekawa et al.

(Continued)

OTHER PUBLICATIONS http://web.archive.org/web/20060316214327/www.sitstay.com/store/equip/eq5.shtml.*

(Continued)

*Primary Examiner*—Steve McAllister
*Assistant Examiner*—Helena Kosanovic
(74) *Attorney, Agent, or Firm*—Harness, Dickey & Pierce, P.L.C.

(57) ABSTRACT

A device for cooling a pet includes a fan with a housing. A motor coupled with a blade positioned in the housing. The motor is electrically coupled with a power source to energize the motor to rotate the blade. At least one member is coupled with the housing. The at least one member includes a cut-out to couple the member with an animal crate to mount the fan on the crate for cooling a pet inside of the crate.

9 Claims, 2 Drawing Sheets

U.S. PATENT DOCUMENTS

| | | | | |
|---|---|---|---|---|
| 6,168,517 | B1 | 1/2001 | Cook | |
| 6,309,192 | B1 | 10/2001 | Litvin | |
| 6,440,190 | B1 | 8/2002 | Goyetche | |
| 6,556,437 | B1 * | 4/2003 | Hardin | 361/679.48 |
| 6,702,664 | B1 * | 3/2004 | Coven | 454/200 |
| 2006/0168925 | A1 * | 8/2006 | Whittemore | 55/490 |

OTHER PUBLICATIONS

12V WindMachine provided by Jade Mountain found at http://www.jademountain.com/heatcool//windmaker.html, Jun. 2000.

12-Volt Fans provided by Chagnon's Outdoor World found at http://www.outdoor-catalog.com/power/air_fans.htm, Sep. 2001.

12-Volt Brushless Fan provided by Kollmann Marine, Inc. found at http://www.kollmann-marine.com/fans.html, Sep. 2001.

Oscillating 12 Volt Mini-Fan provided by Solar Generators found at http://www.solargenerators.com/fans.htm, Sep. 2001.

Ultra-Thin Line 12-Volt Electric Fans provided by Fluidyne Racing Products found at http://fluidyne.com/fans.html, Sep. 2001.

"Fan-Tastic Vent Model 4000R brochure", www.fantasticvent.com.

"Fan-Tastic Vent" printout of website, www.fantasticvent.com.

* cited by examiner

FAN WITH ATTACHMENT HOOKS

FIELD

The disclosure relates to a cooling device and, more particularly, to a fan which includes an attachment mechanism coupling the fan with a pet crate.

BACKGROUND

During adverse weather conditions, oppressive heat takes a toll on household pets. Ordinarily, when pets are transported from place to place in a crate or cage, mechanisms do not exist to cool the pets. When pets are caged or crated at various venues, such as a pet show, where the pet may be in the cage or crate for a substantial amount of time, it is desirable to make the wait for the pet as pleasant as possible. In the past, mechanism did not exist to provide a cooling effect to the pets while they were in their crates waiting for a particular event to occur. Thus, it would be desirable to provide a portable system which is capable of cooling the pet when needed.

SUMMARY

The present disclosure provides the art with an apparatus for cooling a pet in a crate or cage. The present disclosure provides a portable mechanism to removably secure a cooling device with a cage or crate. The present disclosure provides a fan including a member to secure the fan with a cage or crate. The present disclosure enables positioning of the securement members to enable the air to be forced into the crate or to be withdrawn from it.

In accordance with the disclosure, a forced air device comprises a fan including a housing. A blade is rotatable in the housing. A motor rotates the blade and is coupled with a power source. A hanging member couples with the housing. The hanging member is multi-positional with respect to the housing to enable multi-positioning of the housing with respect to the area to be cooled. A recess is in the hanging member to couple the hanging member with a cage or crate. The hanging member pivots with respect to the housing. The housing includes two major sides with grates which enables air to pass through the grates from the blade. The hanging member pivots from one major side to the other. The recess defines a concave arcuate surface. The fan includes a handle which is coupled with the hanging member to enable pivoting from side to side.

According to a second aspect of the disclosure, a device for cooling a pet comprises a fan having a housing with a motor coupled with the blade positioned in the housing. A power source is electrically coupled with the motor to energize the motor to rotate the blade. At least one member is coupled with the housing. The member includes a cut-out for coupling with an animal crate or cage to mount a fan on the crate to cool a pet inside the crate. The motor is a DC motor. The at least one member is pivotally secured on the housing and includes a concave surface in the member. Preferably, there is a pair of members on the portable fan.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
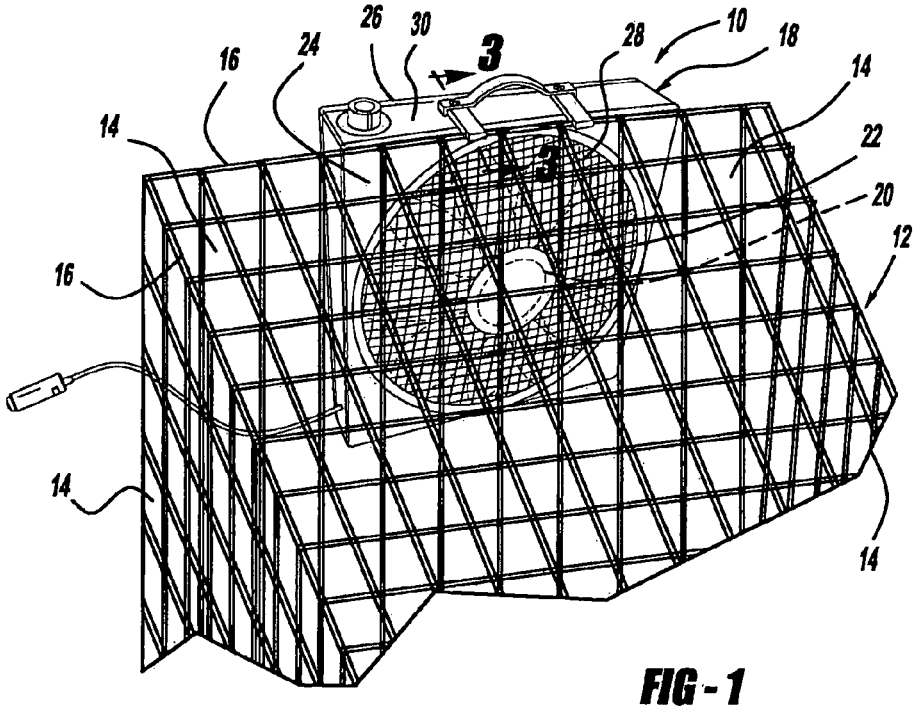
FIG. 1 is a perspective view of the cooling device on a pet crate.

Turning to the figures, particularly FIG. 1, a cooling device, such as a fan, is illustrated and designated with the reference numeral 10. The fan 10 is illustrated secured to a pet crate 12. The pet crate is one of a steel rod construction. The rods are secured with one another to form a crisscross pattern on the crate as seen in FIG. 1. Preferably, the crate is of the knock down type. The crate includes a plurality of walls 14 formed by individual rods 16 which are secured with other rods to form a rectangular pattern. The diameter of the rod is determined by the particular gauge of the rod used to manufacture the crate.

The fan 10 includes a housing 18, with a motor 20 rotating a blade 22 positioned within the fan housing 18. The fan housing includes a pair of major sides 24 and 26 which includes a grate cover 28. The covers 28 are substantially identical to one another. The fan includes a wall 30 which has an overall rectangular shape which connects the major sides to one another. Thus, the fan housing 18 has an overall box shape.

Figure 2:
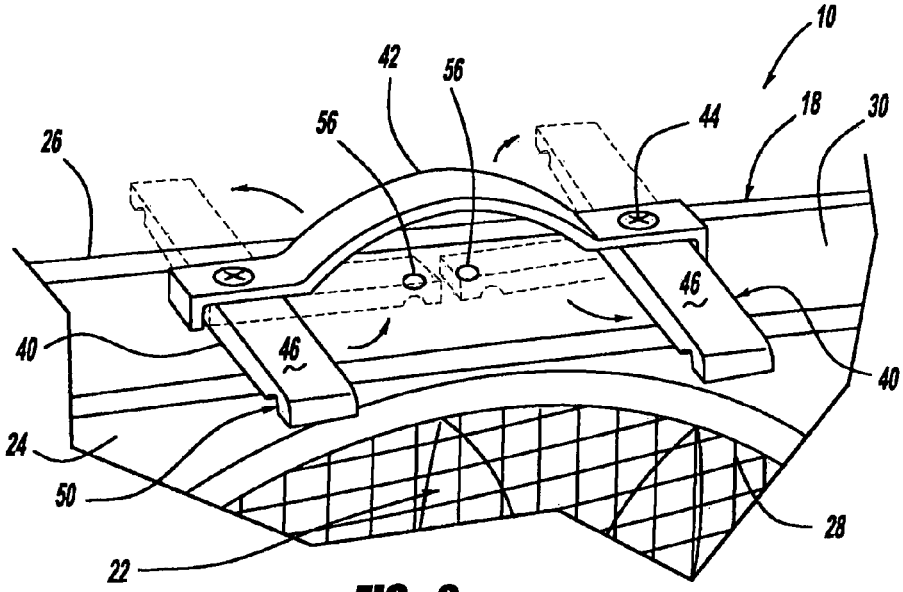
FIG. 2 is a top perspective view of the fan and securement elements.

A pair of hanging members 40 is pivotally secured to the housing wall 30. The hanging members 40 pivot from one major side of the fan housing to the other as seen in FIG. 2. Also, a handle 42 is coupled with the hanging members 40. Fasteners 44 pass through the handle 42 and the hanging members 40. The fasteners 44 act as pivots to enable the hanging members 40 to pivot or rotate with respect to one another and the housing 18. Also, the hanging members 40 are sized such that the hanging members can be rotated underneath the handle so that they are positioned along a common axis underneath the handle in a non-use position.

Figure 3:
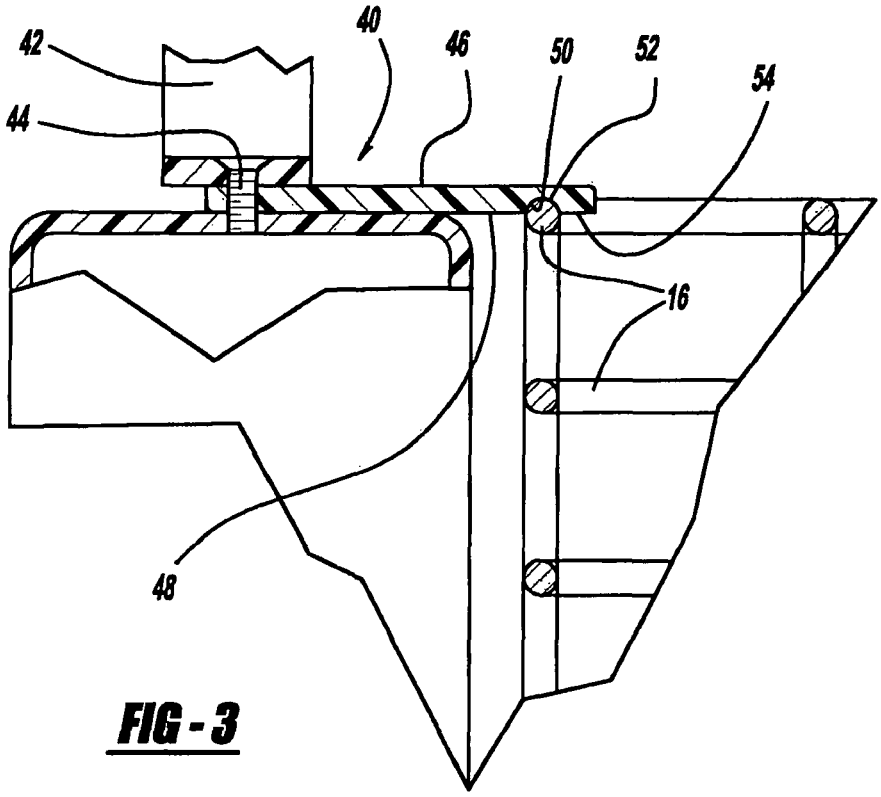
FIG. 3 is a cross-section view of FIG. 1 along line 3-3 thereof.

The hanging members 40 are substantially identical and the discussion with respect to one will apply to both. The hanging members 40 have an overall rectangular configuration. The member 40 has two major sides. A top side 46 and a bottom side 48 which are adjacent to and in contact with the housing wall 30. The bottom side 48 includes a cut-out or recess 50. The cut-out or recess 50 defines an arcuate concave surface 52 in the hanging member 40. The arcuate concave surface 52 is sized to cover at least half of the surface of the rod 16 as illustrated in FIG. 3. The diameter of the surface 52 is slightly larger than the diameter of the rods 16. Also, it may be about equal so that it snaps fits onto the rod 16. Thus, the recess or cut-out 50 fits onto the rod 16 to provide hanging of the fan against the crate as illustrated in FIG. 1. The bottom side 48 may also include a detent or bump 54. The detent 54 may fit in an aperture 56 in the wall 30 to retain the hanging member 40 in a non-use position.

The fan is a DC fan and can be connected with a battery. The fan may include a power cord with an electrical fitting which may be positioned into the cigarette lighter of a vehicle. Thus, the fan may be running while the crate is in transit in a vehicle. Additionally, the fan can be run off of a battery pack so that the crate can be positioned at a venue, such as a pet show, to provide the pet with cooling.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A forced air device comprising:

a fan having a housing, a blade rotatable in said housing, a motor for rotating said blade and a power source for powering said motor;

a hanging member coupled with said housing, said hanging member being multi-positional with respect to said housing for enabling multi-positioning of said housing in different orientations with respect to the area to be cooled, said hanging member pivotally secured on said housing;

a handle mounted on a top surface said housing and said hanging member being directly pivotally coupled with said handle for movement substantially parallel with said top surface; and a recess in said hanging member for coupling said hanging member with a crate.

2. The forced air device according to claim 1, wherein said housing includes two major sides having grates for enabling forced air to pass through from said blade, and said hanging member pivots from major side to major side enabling each major side to be orientated against the area to be cooled.

3. The forced air device according to claim 1, wherein said recess defines an arcuate surface on said hanging member.

4. The forced air device according to claim 3, wherein said surface is concave.

5. A device for cooling a pet comprising:

a fan having a housing with a motor coupled with a blade positioned in said housing, a power source electrically coupled with said motor for energizing said motor for rotating said blade;

a pair of members coupled with said housing, each said member including a cut-out for coupling with an animal crate for mounting said fan on the crate for cooling a pet inside the crate, said pair of members both pivotally secured with a top surface of the housing such that they pivot toward and away from one another along said top surface from a use to non-use position and when said pair of members are in said non-use position they are positioned along a common axis said pair of members also being pivotally attached to a handle.

6. The device according to claim 5, wherein said motor is a DC motor.

7. The device according to claim 5, wherein said at least one member is pivotably secured on said housing.

8. The device according to claim 5, wherein said cut-out defining a concave surface in said member.

9. The device according to claim 5, wherein said fan is portable.

* * * * *